US008749126B2

(12) United States Patent
Durham et al.

(10) Patent No.: US 8,749,126 B2
(45) Date of Patent: Jun. 10, 2014

(54) CORONA IGNITER ASSEMBLY INCLUDING CORONA ENHANCING INSULATOR GEOMETRY

(75) Inventors: Patrick Durham, Troy, MI (US); James Lykowski, Temperance, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 15 days.

(21) Appl. No.: 13/534,251

(22) Filed: Jun. 27, 2012

(65) Prior Publication Data

US 2013/0003251 A1 Jan. 3, 2013

Related U.S. Application Data

(60) Provisional application No. 61/501,372, filed on Jun. 27, 2011.

(51) Int. Cl.
*H01T 19/00* (2006.01)

(52) U.S. Cl.
USPC ..... 313/141; 313/138; 313/144; 123/169 EL

(58) Field of Classification Search
None
See application file for complete search history.

(56) References Cited

U.S. PATENT DOCUMENTS

| | | | | |
|---|---|---|---|---|
| 4,774,914 | A | 10/1988 | Ward | |
| 4,798,991 | A | 1/1989 | Benedikt et al. | |
| 5,619,959 | A | 4/1997 | Tozzi | |
| 6,883,507 | B2 | 4/2005 | Freen | |
| 7,204,220 | B2 | 4/2007 | Schmidt et al. | |
| 7,741,761 | B2 | 6/2010 | Jaffrezic et al. | |
| 7,843,117 | B2 | 11/2010 | Jaffrezic et al. | |
| 7,928,642 | B2 | 4/2011 | Malek et al. | |
| 2004/0033126 | A1* | 2/2004 | Thogersen | 414/398 |
| 2007/0114901 | A1* | 5/2007 | Nagasawa et al. | 313/141 |
| 2007/0221156 | A1* | 9/2007 | Hagiwara et al. | 123/143 B |
| 2009/0107439 | A1 | 4/2009 | Schultz | |
| 2010/0045157 | A1 | 2/2010 | Nguyen | |
| 2010/0083942 | A1 | 4/2010 | Lykowski et al. | |
| 2010/0165539 | A1* | 7/2010 | Sakakura | 361/253 |
| 2010/0175653 | A1 | 7/2010 | Lykowski et al. | |
| 2010/0175655 | A1 | 7/2010 | Lykowski et al. | |
| 2011/0146640 | A1 | 6/2011 | Achstaetter et al. | |
| 2011/0175514 | A1* | 7/2011 | Kameda | 313/141 |

FOREIGN PATENT DOCUMENTS

FR 2 859 831 A1 9/2012

OTHER PUBLICATIONS

International Search Report PCT/US2012/044324 mailed on Oct. 12, 2012.

* cited by examiner

*Primary Examiner* — Ashok Patel
(74) *Attorney, Agent, or Firm* — Robert L. Stearns; Dickinson Wright, PLLC

(57) ABSTRACT

A corona igniter 20 includes a central electrode 34 for receiving a high radio frequency voltage from a power source and emitting a radio frequency electric field to ionize a fuel-air mixture and provide a corona discharge 22. The corona igniter 20 includes an insulator 38 extending along the central electrode 34 longitudinally past the central electrode 34 to an insulator firing end 40. The insulator firing surface 42 and the center axis A present an angle α of not greater than 90 degrees therebetween, for example the insulator firing surface may be concave. The central electrode 34 may also include a firing tip 50, in which case the insulator firing surface 42 surrounds all sides of the firing tip 50. The geometry of the insulator firing surface 42 concentrates and directs the corona discharge 22.

19 Claims, 10 Drawing Sheets

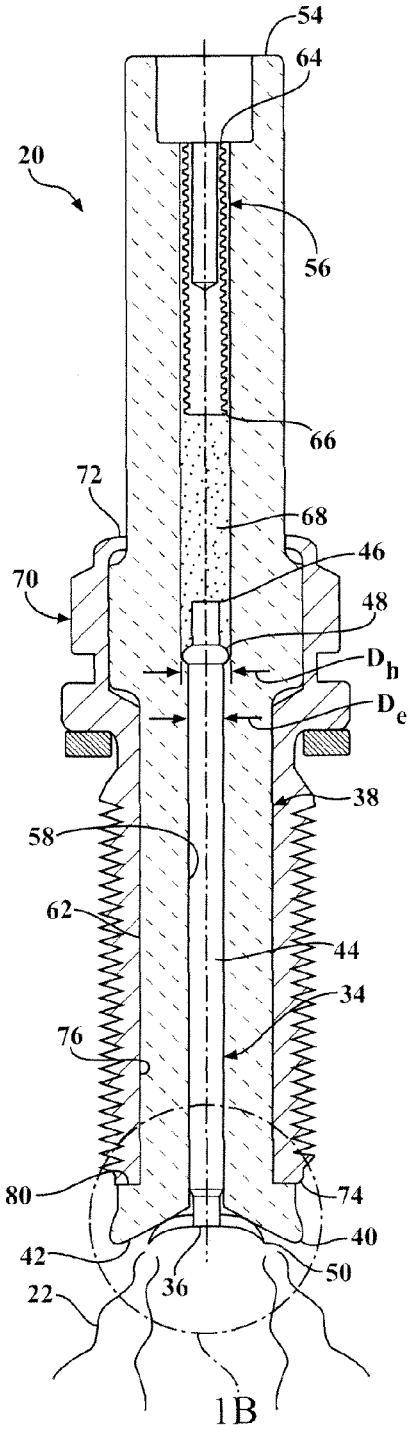
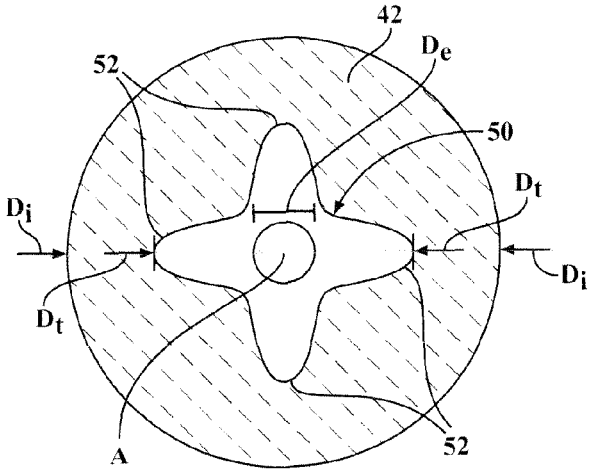
FIG. 1C
FIG. 1A

CORONA IGNITER ASSEMBLY INCLUDING CORONA ENHANCING INSULATOR GEOMETRY

CROSS REFERENCE TO RELATED APPLICATION

This application claims the benefit of U.S. provisional application Ser. No. 61/501,372, filed Jun. 27, 2011.

BACKGROUND OF THE INVENTION

1. Field of the Invention

This invention relates generally to a corona igniter for emitting a radio frequency electric field to ionize a fuel-air mixture and provide a corona discharge.

2. Description of the Prior Art

Corona discharge ignition systems provide an alternating voltage and current, reversing high and low potential electrodes in rapid succession which makes arc formation difficult and enhances the formation of corona discharge. The system includes a corona igniter with a central electrode charged to a high radio frequency voltage potential and creating a strong radio frequency electric field in a combustion chamber. The electric field emitted from the central electrode causes a portion of a mixture of fuel and air to ionize and begin dielectric breakdown, facilitating combustion of the fuel-air mixture. An example of a corona discharge ignition system is disclosed in U.S. Pat. No. 6,883,507 to Freen.

The central electrode of the corona igniter is formed of an electrically conductive material, which receives the high radio frequency voltage and emits the radio frequency electric field into the combustion chamber to ionize the fuel-air mixture and provide the corona discharge. An insulator formed of an electrically insulating material surrounds the central electrode and is received in a metal shell. An example of a corona igniter is disclosed in U.S. Patent Application Publication No. US 2010/0083942 to the present inventor, Lykowski. The igniter of the corona discharge ignition system does not include any grounded electrode element intentionally placed in close proximity to a firing end of the central electrode. Rather, the ground is provided by a piston disposed in the combustion chamber below the corona igniter, or by walls of a cylinder block and cylinder head surrounding the corona igniter and forming the combustion chamber.

The intensity of the electric field emitted from the corona igniter is preferably controlled so that the fuel-air mixture maintains dielectric properties and corona discharge, also referred to as a non-thermal plasma, occurs at the central electrode firing end, rather than a thermal plasma or electric arc. The corona discharge provided by the central electrode is also preferably concentrated in a predetermined direction to provide a strong ignition of the fuel-air mixture. However, since the electric field is attracted to the grounded piston, cylinder block, and cylinder head, the corona discharge spreads in many directions, which limits the quality of ignition.

SUMMARY OF THE INVENTION

One aspect of the invention provides a corona igniter for providing a corona discharge in a combustion chamber. The corona igniter includes a central electrode extending longitudinally along a center axis to an electrode firing end. The central electrode receives a high radio frequency voltage and emits a radio frequency electric field from the electrode firing end to ionize a fuel-air mixture and provide the corona discharge. The corona igniter also includes an insulator extending along the central electrode longitudinally past the electrode firing end to an insulator firing end. The insulator also includes an insulator firing surface adjacent the insulator firing end. The insulator firing surface and the center axis present an angle of not greater than 90 degrees therebetween to concentrate the electric field emitted from the central electrode. Therefore, the corona igniter with the corona enhancing insulator geometry provides a high quality ignition of the fuel-air mixture and a better, more stable performance over time than other corona igniters without the corona enhancing insulator geometry.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 1A is a cross-sectional view of a corona igniter according to one embodiment of the invention;

FIG. 1C is a bottom view of an electrode firing end, firing tip, and insulator firing end of the corona igniter of FIG. 1A;

DETAILED DESCRIPTION

Figure 1B:
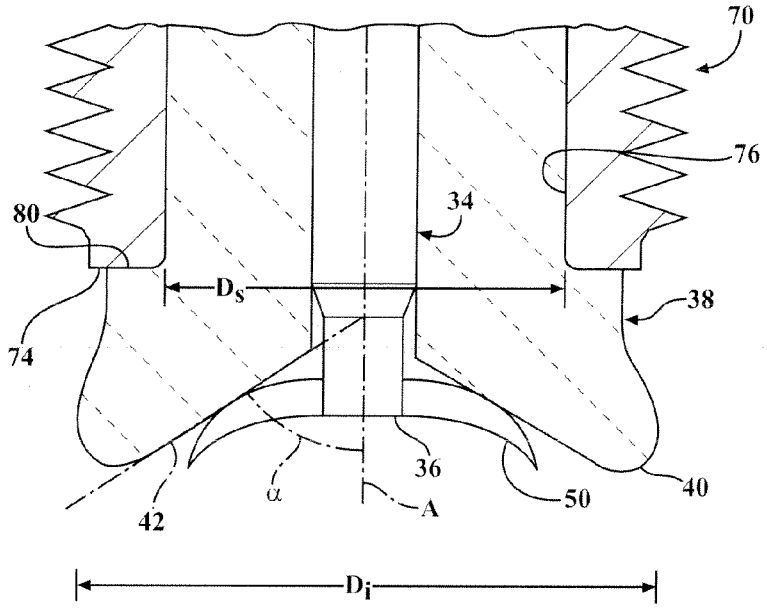
FIG. 1B is an enlarged view of a portion of the corona igniter of FIG. 1A showing an angle ($\alpha$) between an insulator firing surface and a center axis.

One aspect of the invention provides a corona igniter 20 for a corona discharge 22 ignition system. An example of the corona igniter 20 is shown in FIG. 1A. The corona igniter 20 is typically disposed in a cylinder head 24 of an internal combustion engine, as shown in FIGS. 2, 3A, 4A, and 5A. The cylinder head 24 is disposed on a cylinder block 26 having side walls presenting a space therebetween. A piston 30 is disposed in the space and slides along the walls of the cylinder block 26 during operating of the internal combustion engine.

The piston 30 is spaced from the cylinder head 24 to provide a combustion chamber 32 containing a combustible fuel-air mixture.

The corona igniter 20 includes a central electrode 34 extending longitudinally along a center axis A to an electrode firing end 36 for receiving a high radio frequency voltage from a power source (not shown and emitting a radio frequency electric field to ionize the fuel-air mixture and provide a corona discharge 22 in the combustion chamber 32. An insulator 38 extends along the central electrode 34 longitudinally past the electrode firing end 36 to an insulator firing end 40. The insulator 38 includes an insulator firing surface 42 adjacent the insulator firing end 40. The insulator firing surface 42 and the center axis A present an angle α of not greater than 90 degrees therebetween. The angle α between the insulator firing surface 42 and the center axis A is the angle between a line extending along the center axis A and a line tangent to any point along the insulator firing surface 42. The geometry of the insulator firing surface 42 directs the corona discharge 22 provided by the central electrode 34 deep into the combustion chamber 32 toward a ground provided by the piston 30, rather than the ground provided by the cylinder block 26 or cylinder head 24. The electric field emissions and corona discharge 22 are concentrated toward the piston 30 and therefore provide a higher quality ignition of the fuel-air mixture. Thus, the corona igniter 20 provides a better, more stable performance over time than other corona igniters without the corona enhancing insulator geometry.

As shown in FIG. 1A, the central electrode 34 of the corona igniter 20 includes an electrode body portion 44 extending longitudinally along the center axis A from electrode terminal end 46 to the electrode firing end 36. The electrode terminal end 46 receives the high radio voltage and the electrode firing end 36 emits the radio frequency electric to ionize the fuel-air mixture and provide the corona discharge 22. The electrode body portion 44 is formed of an electrically conductive material, such as nickel. The electrode body portion 44 also presents an electrode diameter $D_e$ extending across and perpendicular to the center axis A. In one embodiment, the central electrode 34 includes a head 48 adjacent the electrode terminal end 46. The head 48 has a head diameter $D_h$ greater than the electrode diameter $D_e$.

The central electrode 34 preferably includes a firing tip 50 surrounding the center axis A adjacent the electrode firing end 36 for emitting the radio frequency central electrode 34 field to provide the corona discharge 22, as shown in FIGS. 1A, 2, 4A, and 5A. The firing tip 50 is formed of an electrically conductive material and may include at least one precious metal. In one embodiment, as best shown in FIG. 1C, the firing tip 50 includes a plurality of prongs 52 presenting spaces therebetween and each extending radially outwardly from the center axis A. The prongs 52 of the firing tip 50 present a tip diameter $D_t$ extending across and perpendicular to the center axis A. The tip diameter $D_t$ is preferably greater than the electrode diameter $D_e$.

Figure 3A:
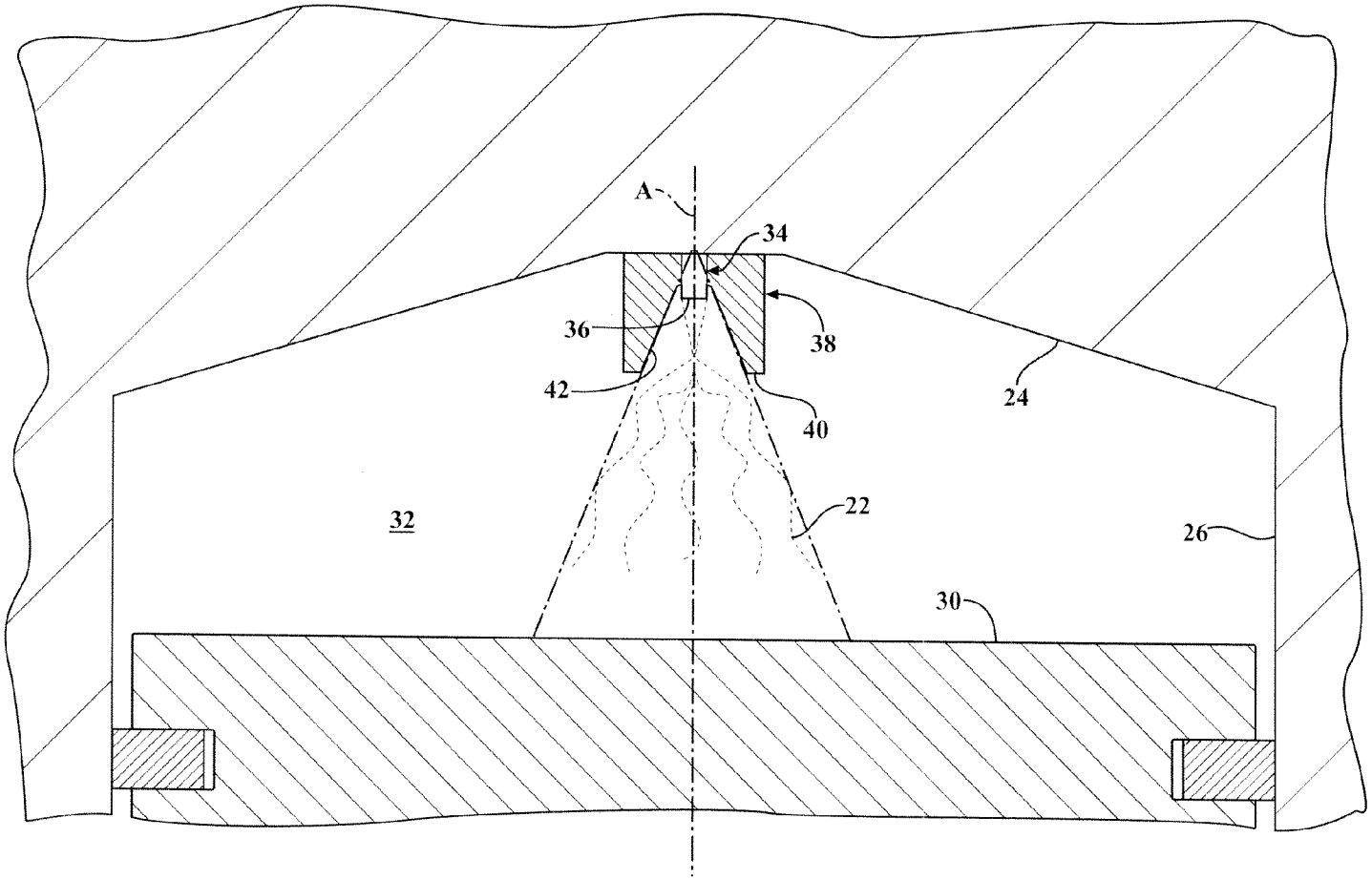
FIG. 3A is a firing end of a corona igniter disposed in a combustion chamber according to another embodiment of the invention.
Figure 4A:
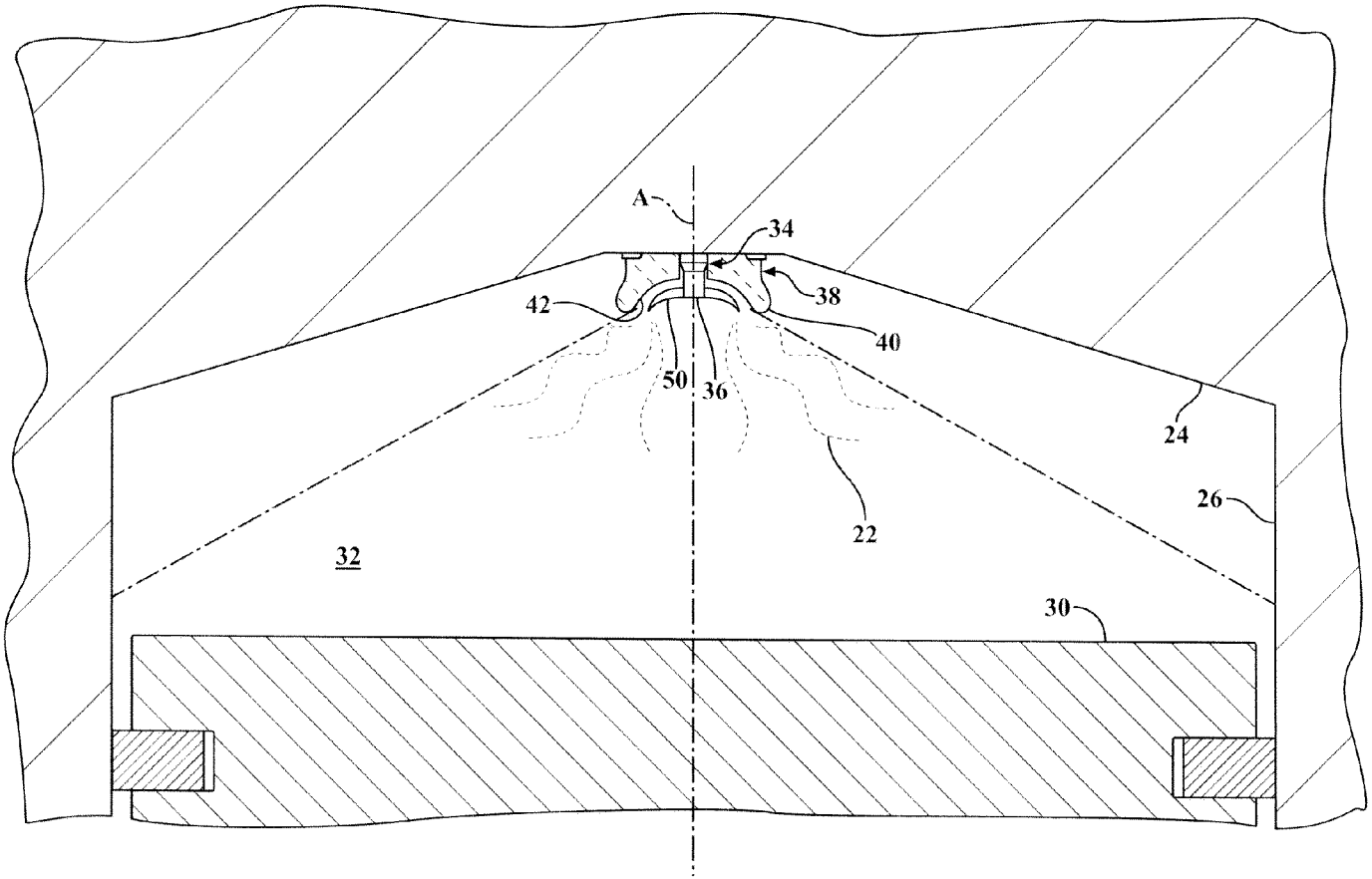
FIG. 4A is a firing end of a corona igniter disposed in a combustion chamber according to yet another embodiment of the invention.
Figure 5B:
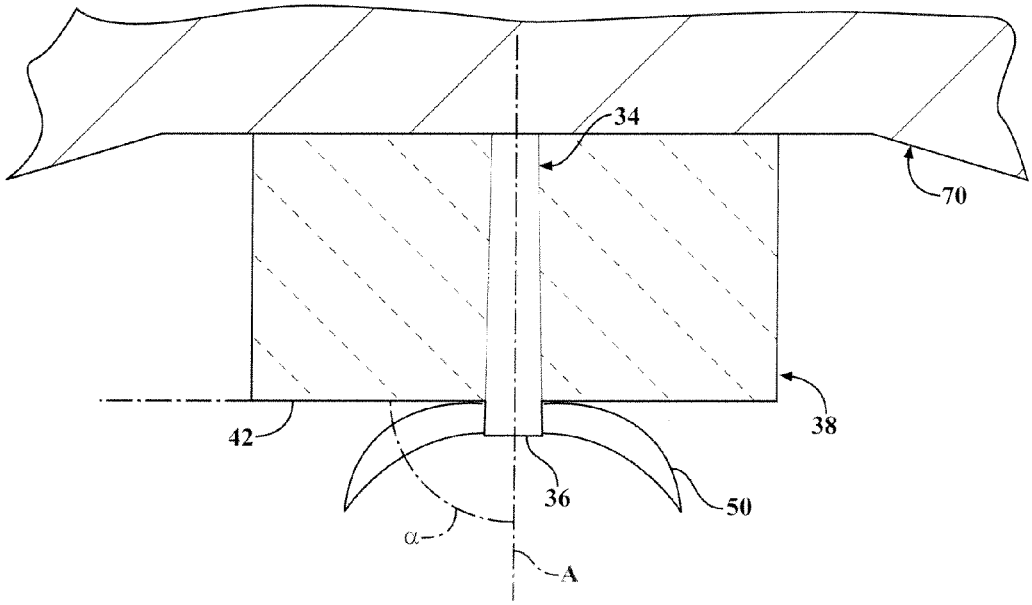
FIG. 5B is an enlarged view of a portion of the corona igniter of FIG. 5A showing an angle between an insulator firing surface and a center axis.
Figure 5A:
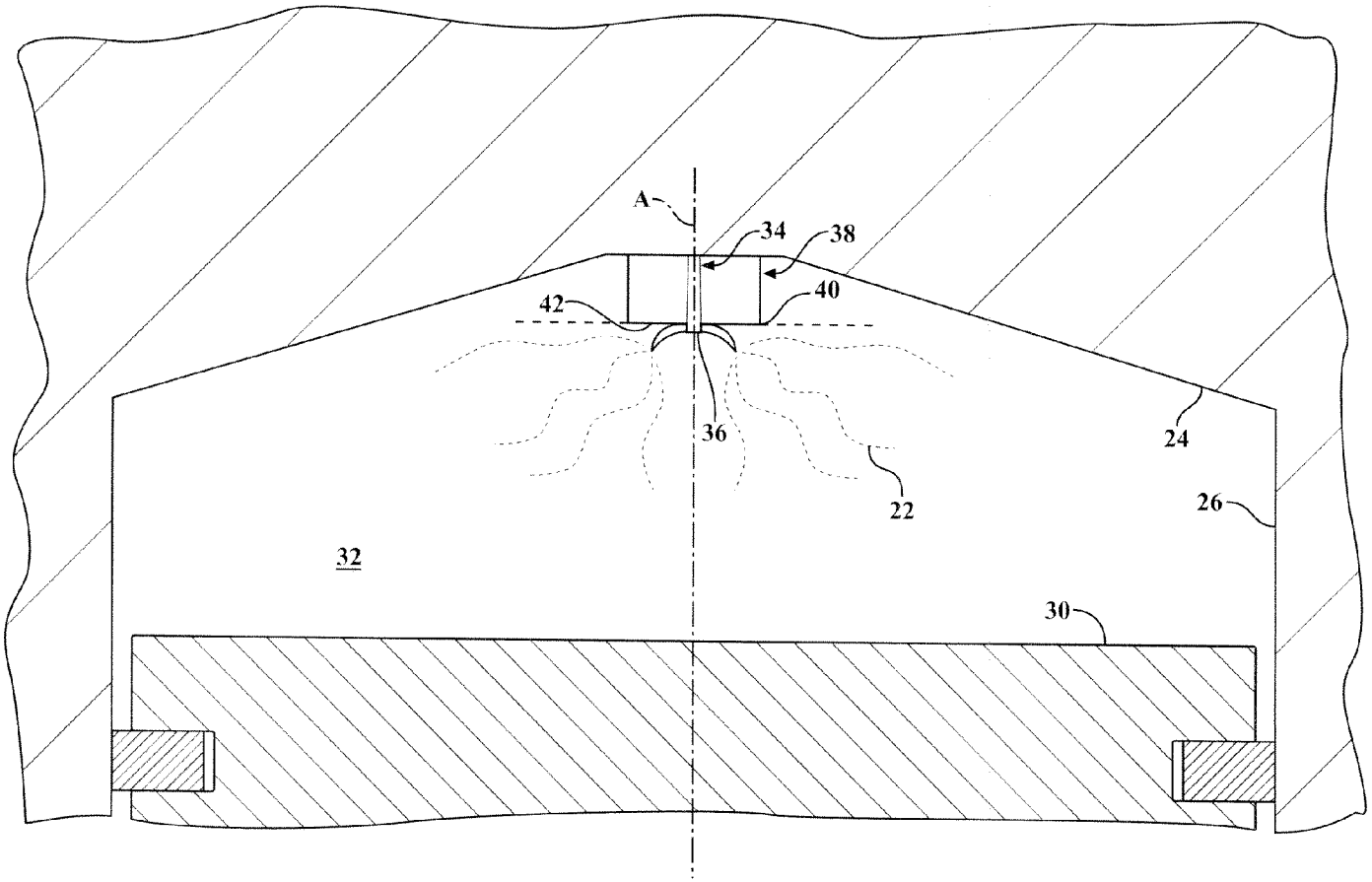
FIG. 5A is a firing end of a corona igniter disposed in a combustion chamber according to yet another embodiment of the invention.

Also shown in FIG. 1A, the insulator 38 of the corona igniter 20 is disposed annularly around and longitudinally along the electrode body portion 44. The insulator 38 extends along the center axis A from an insulator upper end 54 to the insulator firing end 40. The insulator firing end 40 is at a point along the insulator 38 spaced farthest from the insulator upper end 54. The insulator firing end 40 may be rounded, as shown in FIGS. 1A and 2A. Alternatively, the insulator firing end 40 may present one or more sharp points, as shown in FIGS. 3A, 4A, and 5A. The insulator 38 is formed of an electrically insulating material, such as a ceramic material including alumina. The insulator 38 includes an insulator inner surface 58 facing the electrode body portion 44 and presenting a bore for receiving the electrode body portion 44. The insulator 38 also presents an insulator outer surface 62 facing outwardly opposite the insulator inner surface 58.

The insulator firing surface 42 of the insulator 38 extends radially outwardly from the bore to the insulator firing end 40. The insulator firing surface 42 also faces generally toward the firing tip 50 and thus is exposed to the corona discharge 22 during operation. The insulator firing surface 42 and the center axis A present an angle α of not greater than 90 degrees therebetween. The angle α between the insulator firing surface 42 and the center axis A is the angle between a line extending along the center axis A and a line tangent to any point along the insulator firing surface 42. The insulator firing surface 42 presents an insulator diameter $D_i$ extending across and perpendicular to the center axis A. As best shown in FIGS. 1A-1C, the insulator diameter $D_i$ is greater than the electrode diameter $D_e$ and the insulator firing surface 42 extends radially outwardly of the electrode firing end 36 and longitudinally past the electrode firing end 36. Thus, all sides of the electrode firing end 36 are surrounded by the insulator firing surface 42. If the central electrode 34 includes the firing tip 50, then the insulator diameter $D_i$ is greater than the tip diameter $D_t$ and the insulator firing surface 42 extends radially outwardly of the firing tip 50. In this case, the insulator firing surface 42 surrounds all sides of the firing tip 50. FIGS. 1A-1C show an example of the insulator firing surface 42 surrounding all sides of the firing tip 50 and extending radially past all prongs 52 of the firing tip 50. The insulator firing surface 42 may engage the firing tip 50, as shown in FIGS. 1A, 2, 3A, and 5A, or may be spaced slightly from the firing tip 50, as shown in FIG. 4A.

The geometry of the insulator 38 and especially the insulator firing surface 42 directs the electric field emitted from the central electrode 34 in a predetermined direction. As shown in the Figures, the insulator firing surface 42 typically directs the electric field emissions and corona discharge 22 toward the piston 30 and prevents the corona discharge 22 from reaching the cylinder block 26 and cylinder head 24. The geometry of the insulator firing surface 42 also concentrates the corona discharge 22. The angle α presented between the insulator firing surface 42 and the center axis A may be adjusted to adjust the degree of concentration. For example, a smaller angle α may provide a more concentrated corona discharge 22 and a larger angle α may provide a less concentrated corona discharge 22. The dashed lines in the Figures show the limit of corona discharge 22 formation provided by the insulator firing surface 42.

Figure 3B:
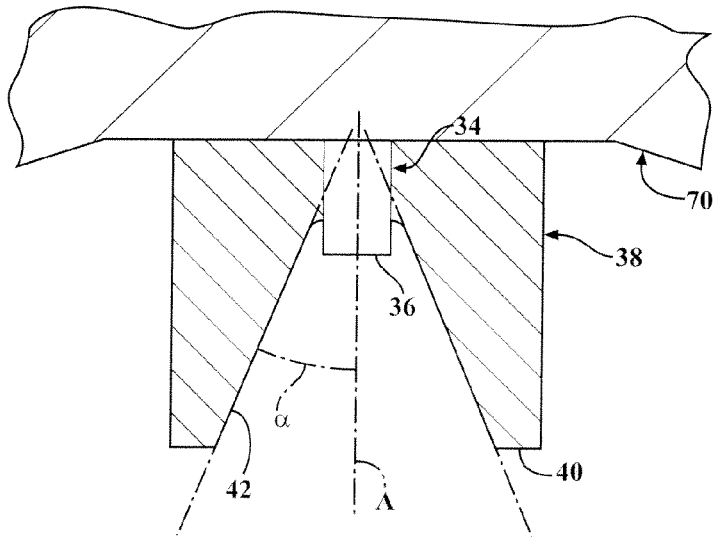
FIG. 3B is an enlarged view of a portion of the corona igniter of FIG. 3A showing an angle between an insulator firing surface and a center axis.
Figure 2:
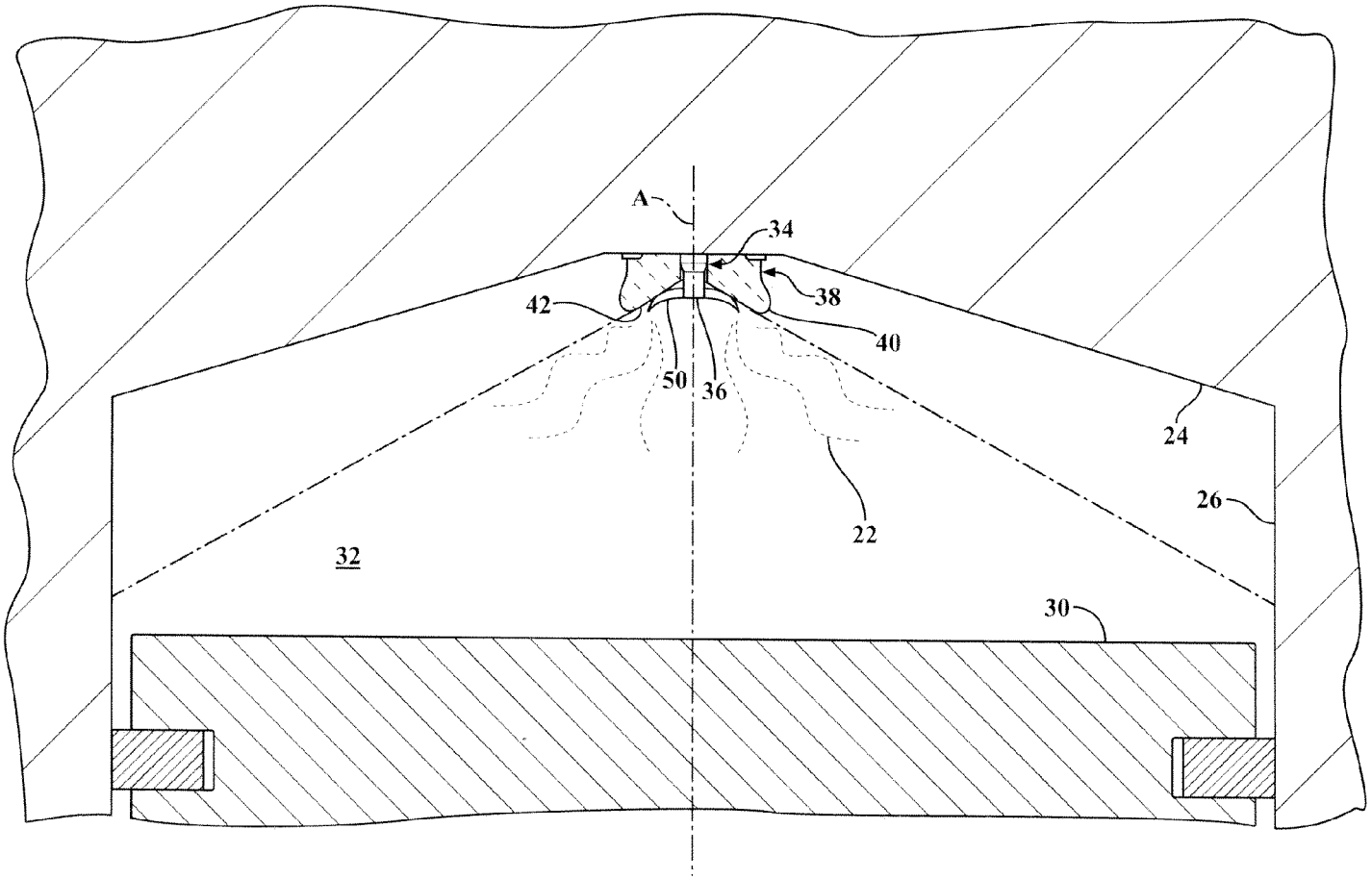
FIG. 2 shows a portion of the corona igniter of FIG. 1A disposed in a combustion chamber.
Figure 4B:
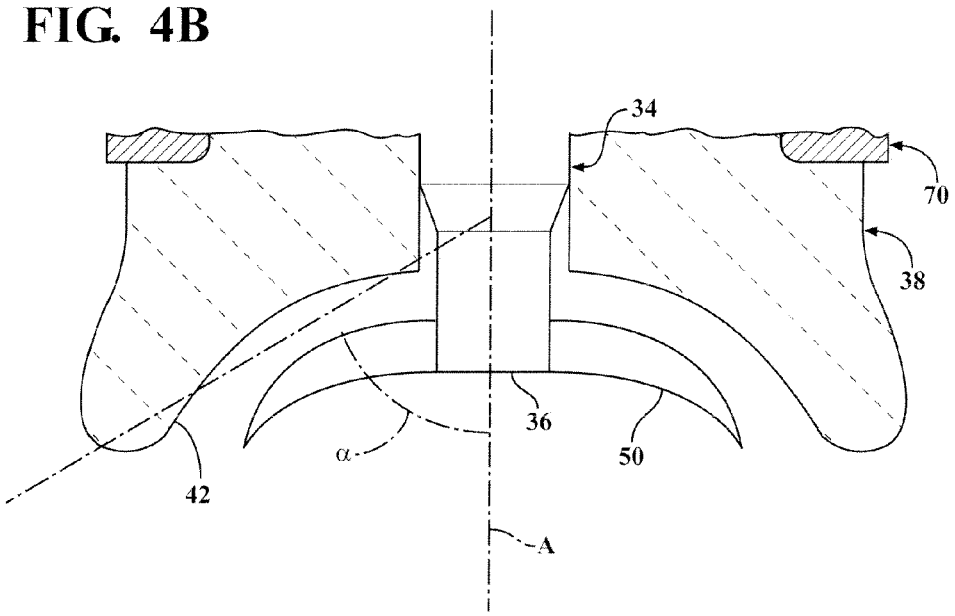
FIG. 4B is an enlarged view of a portion of the corona igniter of FIG. 4A showing an angle between an insulator firing surface and a center axis.

In one embodiment, as shown in FIGS. 1-3, the insulator firing surface 42 extends transversely from the bore to the insulator firing end 40. In this embodiment, the insulator firing surface 42 and center axis A may present an angle α of 30 to 60 degrees therebetween, as best show in FIGS. 1B and 2B. Alternatively, the firing surface and center axis A may present an angle α of 10 to 30 degrees therebetween, as best shown in FIG. 3B. In another embodiment, as best shown in FIG. 4B, the insulator firing surface 42 is concave. In the embodiment of FIG. 4B, the angle α between the insulator firing surface 42 and the center axis A changes along the length of the insulator firing surface 42, but is consistently 90 degrees or less. In yet another embodiment, the insulator firing surface 42 is planar such that the insulator firing surface 42 and the center axis A present an angle α of 90 degrees therebetween, as best shown in FIG. 5B.

The corona igniter 20 also includes a terminal 56 formed of an electrically conductive material and received in the bore of the insulator 38 for transmitting energy from the power source (not shown) to the central electrode 34. The terminal 56 extends longitudinally along the center axis A from a first terminal end 64, which receives the energy from the power source, to a second terminal end 66, which is in electrical communication with the central electrode 34. A conductive seal layer 68 formed of an electrically conductive material is disposed between and electrically connects the second terminal end 66 and the electrode terminal end 46.

The corona igniter 20 also includes a shell 70 formed of an electrically conductive metal material, such as steel or a steel alloy, disposed annularly around the insulator outer surface 62. The shell 70 extends longitudinally along the insulator outer surface 62 from a shell upper end 72 to a shell lower end 74. The shell 70 includes a shell inner surface 76 extending along the insulator outer surface 62 and presenting a shell bore for receiving the insulator 38. As shown in FIG. 1B, the shell inner surface 76 presents a shell diameter $D_s$ extending across and perpendicular to the center axis A.

In one embodiment, as shown in FIG. 1B, the insulator diameter $D_i$ of the insulator firing surface 42 is greater than the shell diameter $D_s$ at the shell lower end 74. In this embodiment, the insulator diameter $D_i$ also increases from the shell lower end 74 to the insulator firing end 40 and the insulator outer surface 62 presents a ledge 80 spaced from the insulator firing end 40, adjacent the shell lower end 74. The shell lower end 74 is disposed on the ledge 80 such that a portion of the insulator outer surface 62 extends along and supports the shell lower end 74.

The insulator 38 geometry of the corona igniter 20 concentrates and directs the corona discharge 22 toward the piston 30, and prevents the corona discharge 22 from traveling toward the cylinder block 26 and cylinder head 24. The dashed lines of the Figures show that the corona igniter 20 concentrates the corona discharge 22 to a certain extent and directs the corona discharge 22 in a certain direction. The extent of concentration and direction both depend on the angle $\alpha$ between the insulator firing surface 42 and the center axis A.

Figure 6:
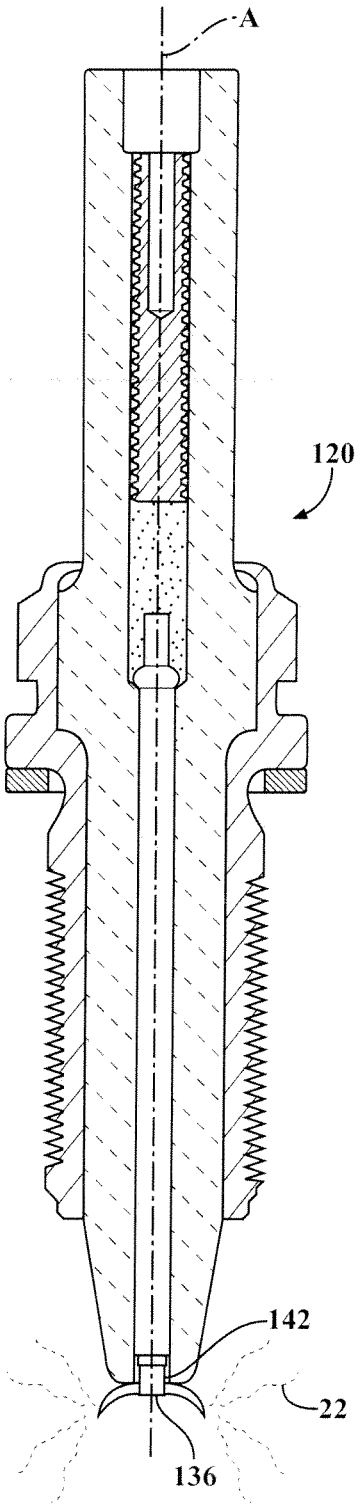
FIG. 6 Related Art
FIG. 6 is a cross-section view of a comparative corona igniter.
Figure 7A:
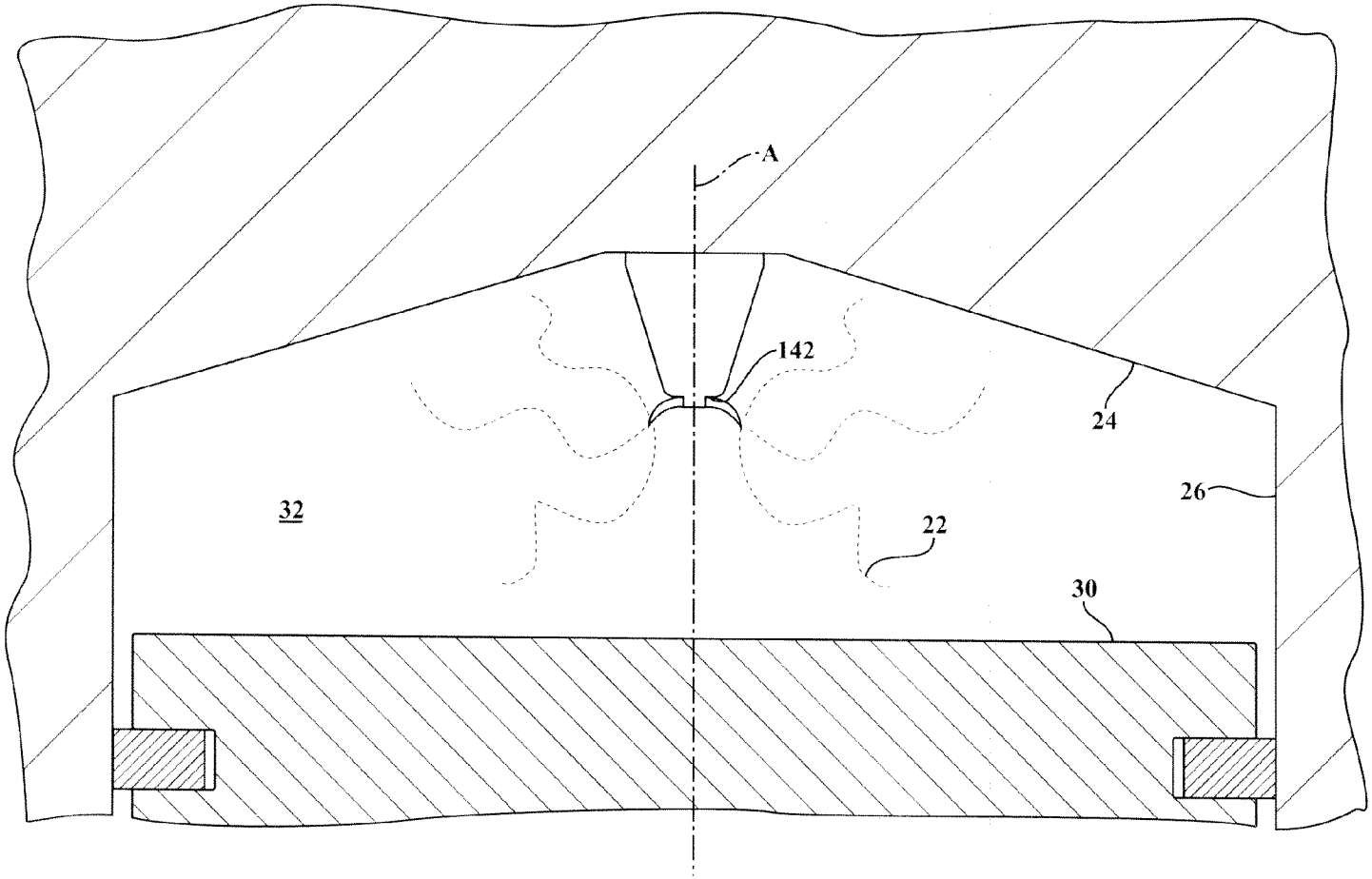
FIG. 7A Related Art
FIG. 7A shows the firing end of the comparative corona igniter of FIG. 6 disposed in a combustion chamber.
Figure 7B:
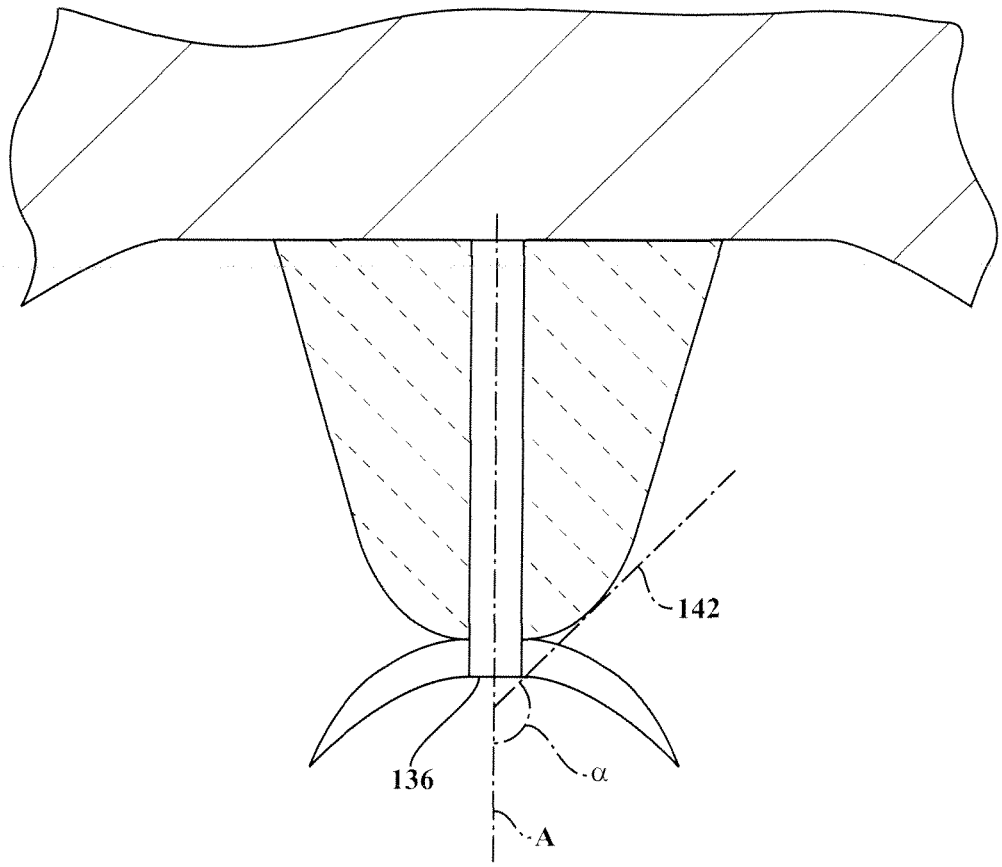
FIG. 7B Related Art
FIG. 7B is an enlarged view of a portion of the corona igniter of FIG. 7A showing an angle between an insulator firing surface and a center axis.

FIGS. 6, 7A, and 7B show a comparative corona igniter 120 without the insulator geometry of the present invention. The insulator firing surface 142 and the center axis A of the comparative corona igniter 120 present an angle $\alpha$ of greater than 90 degrees therebetween, as shown in FIG. 7B. The insulator firing surface 142 of the comparative corona igniter 120 is convex and the electrode firing end 136 extends longitudinally past the insulator firing surface 142. The corona discharge 22 provided by the comparative corona igniter 120 is less concentrated and travels toward the walls of the cylinder block 26 and cylinder head 24. Therefore, the corona igniter 20 of the present invention provides a higher quality ignition of the fuel-air mixture and a better, more stable performance over time, compared to other corona igniters, such as the corona igniter 120 of FIG. 6.

Obviously, many modifications and variations of the present invention are possible in light of the above teachings and may be practiced otherwise than as specifically described while within the scope of the appended claims.

What is claimed is:

1. A corona igniter, comprising:

a central electrode extending longitudinally along a center axis to an electrode firing end for receiving a radio frequency voltage and emitting a radio frequency electric field from said electrode firing end to ionize a fuel-air mixture and provide a corona discharge, an insulator extending along said central electrode longitudinally past said electrode firing end to an insulator firing end, said insulator including an insulator firing surface adjacent said insulator firing end, and said insulator firing surface and said center axis presenting an angle of not greater than 90 degrees therebetween.

2. The corona igniter of claim 1 wherein said insulator extends longitudinally past said electrode firing end.

3. The corona igniter of claim 1 wherein said insulator firing surface surrounds said electrode firing end.

4. The corona igniter of claim 1 wherein said insulator presents a bore for receiving said central electrode and said insulator firing surface extends transversely from said bore to said insulator firing end.

5. The corona igniter of claim 1 wherein said insulator firing surface is concave.

6. The corona igniter of claim 1 wherein said insulator firing surface is planar.

7. The corona igniter of claim 1 wherein said insulator firing surface and said center axis present an angle of 30 to 60 degrees therebetween.

8. The corona igniter of claim 1 wherein said insulator firing surface and said center axis present an angle of 10 to 30 degrees therebetween.

9. The corona igniter of claim 1 wherein said central electrode includes a firing tip adjacent said electrode firing end for emitting the radio frequency electrical field and said insulator firing surface extends radially outwardly of said firing tip.

10. The corona igniter of claim 9 wherein said firing tip includes a plurality of prongs each extending radially outwardly from said center axis.

11. The corona igniter of claim 1 wherein said insulator firing surface and said center axis present an angle of less than 90 degrees therebetween.

12. The corona igniter of claim 9 wherein said insulator firing surface surrounds said firing tip.

13. A corona igniter of claim 1, comprising:

a central electrode extending longitudinally along a center axis to an electrode firing end for receiving a radio frequency voltage and emitting a radio frequency electric field from said electrode firing end to ionize a fuel-air mixture and provide a corona discharge, an insulator extending along said central electrode longitudinally past said electrode firing end to an insulator firing end, said insulator including an insulator firing surface adjacent said insulator firing end, said insulator firing surface and said center axis presenting an angle of not greater than 90 degrees therebetween, and further including a shell disposed around said insulator and extending along said center axis from a shell upper end to a shell lower end, said shell including a shell inner surface facing said insulator and presenting a shell diameter extending across said center axis, and wherein said insulator firing surface presents an insulator diameter extending across said center axis, and said insulator diameter being greater than said shell diameter at said shell lower end.

14. The corona igniter of claim 13 wherein said insulator diameter increases from said shell lower end to said insulator firing end.

15. The corona igniter of claim 13 wherein said insulator outer surface presents a ledge disposed along said shell lower end.

16. A corona igniter for a corona discharge ignition system, comprising:

an central electrode including an electrode body portion extending longitudinally along a center axis from an electrode terminal end to an electrode firing end for receiving a radio frequency voltage at said electrode terminal end and emitting a radio frequency electric field from said electrode firing end to ionize a fuel-air mixture and provide a corona discharge, said electrode body portion being formed of an electrically conductive material, said electrode body portion presenting an electrode diameter extending across and perpendicular to said center axis, said central electrode including head at said electrode terminal end and having a head diameter greater than said electrode diameter, said central electrode including a firing tip formed of an electrically conductive material surrounding said center axis adjacent said electrode firing end for emitting the radio frequency electric field to provide the corona discharge, said firing tip including a plurality of prongs presenting spaces therebetween and each extending radially outwardly from said center axis, said firing tip presenting a tip diameter extending across and perpendicular to said center axis, said tip diameter being greater than said electrode diameter, an insulator formed of an electrically insulating material disposed annularly around and longitudinally along said electrode body portion and extending along said center axis from an insulator upper end to an insulator firing end, said electrically insulating material being a ceramic material, said insulator including an insulator inner surface facing said electrode body portion and presenting a bore for receiving said electrode body portion, said insulator presenting an insulator outer surface facing outwardly opposite said insulator inner surface, said insulator including an insulator firing surface extending radially outwardly from said bore to said insulator firing end, said insulator firing surface and said center axis presenting an angle of not greater than 90 degrees therebetween, said insulator firing surface extending longitudinally past said electrode firing end and radially outwardly of said firing tip, said insulator firing surface presenting an insulator diameter extending across and perpendicular to said center axis and being greater than said electrode diameter and said tip diameter, said insulator firing end being convex, a terminal formed of an electrically conductive material received in said bore of said insulator, said terminal extending longitudinally along said center axis from a first terminal end to a second terminal end in electrical communication with said electrode terminal end, a conductive seal layer formed of an electrically conductive material disposed between and electrically connecting said second terminal end and said electrode terminal end, a shell formed of an electrically conductive metal material disposed annularly around said insulator outer surface, said shell extending longitudinally along said center axis from a shell upper end to a shell lower end, said shell presenting a shell inner surface extending along said insulator outer surface and presenting a shell bore receiving said insulator, said shell inner surface presenting a shell diameter extending across and perpendicular to said center axis, and said insulator diameter of said insulator firing surface being greater than said shell diameter at said shell lower end.

17. The corona igniter of claim 16 wherein said insulator firing surface and said center axis present an angle of less than 90 degrees therebetween.

18. A corona igniter, comprising:

a central electrode extending longitudinally along a center axis to an electrode firing end for receiving a radio frequency voltage and emitting a radio frequency electric field from said electrode firing end to ionize a fuel-air mixture and provide a corona discharge, an insulator extending along said central electrode longitudinally past said electrode firing end to an insulator firing end, said insulator including an insulator firing surface adjacent said insulator firing end, said insulator firing surface and said center axis presenting an angle of not greater than 90 degrees therebetween, said central electrode including a firing tip adjacent said electrode firing end for emitting the radio frequency electrical field and said insulator firing surface extending radially outwardly of said firing tip, and wherein said insulator firing surface presents an insulator diameter and said central electrode presents an electrode diameter and said firing tip presents a tip diameter, each of said diameters extend across said center axis, and said insulator diameter is greater than said electrode diameter and said tip diameter.

19. The corona igniter of claim 18 wherein said insulator firing surface and said center axis present an angle of less than 90 degrees therebetween.

* * * * *